US009904220B2

(12) United States Patent
Saito et al.

(10) Patent No.: US 9,904,220 B2
(45) Date of Patent: Feb. 27, 2018

(54) FIXING DEVICE AND IMAGE FORMING APPARATUS

(71) Applicants: Kazuya Saito, Kanagawa (JP); Yasunori Ishigaya, Kanagawa (JP); Keitaro Shoji, Kanagawa (JP); Hiromasa Takagi, Tokyo (JP); Toshihiko Shimokawa, Kanagawa (JP)

(72) Inventors: Kazuya Saito, Kanagawa (JP); Yasunori Ishigaya, Kanagawa (JP); Keitaro Shoji, Kanagawa (JP); Hiromasa Takagi, Tokyo (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/434,948

(22) Filed: Feb. 16, 2017

(65) Prior Publication Data

US 2017/0248885 A1 Aug. 31, 2017

(30) Foreign Application Priority Data

Feb. 25, 2016 (JP) ..... 2016-034112
Oct. 17, 2016 (JP) ..... 2016-203426

(51) Int. Cl.
*G03G 15/20* (2006.01)

(52) U.S. Cl.
CPC ..... *G03G 15/2053* (2013.01); *G03G 15/2046* (2013.01); *G03G 15/2007* (2013.01); *G03G 2215/2035* (2013.01)

(58) Field of Classification Search
CPC ..... G03G 15/2053; G03G 15/2007; G03G 15/2046; G03G 2215/2035
See application file for complete search history.

(56) References Cited

U.S. PATENT DOCUMENTS

2012/0121305 A1 5/2012 Yoshikawa et al.
2013/0170879 A1 7/2013 Yoshinaga et al.
2013/0183071 A1 7/2013 Iwaya et al.
2014/0072355 A1 3/2014 Tamaki et al.
(Continued)

FOREIGN PATENT DOCUMENTS

JP 2004-235001 8/2004
JP 2010-032625 2/2010
(Continued)

*Primary Examiner* — Joseph S Wong
(74) *Attorney, Agent, or Firm* — Oblon, McClelland, Maier & Neustadt, L.L.P.

(57) ABSTRACT

A fixing device includes a fixing belt and an opposed rotator to press against a nip formation pad via the fixing belt to form a fixing nip between the fixing belt and the opposed rotator. A primary heater and a secondary heater heat the fixing belt. The secondary heater includes a lateral end heat generator. The nip formation pad includes a base and at least one thermal conductor being interposed between the base and the fixing nip and having a thermal conductivity greater than a thermal conductivity of the base. The at least one thermal conductor includes an outboard edge disposed between an inboard edge and an outboard edge of the lateral end heat generator and disposed outboard from a conveyance span of the fixing belt in an axial direction of the fixing belt, where a recording medium is conveyed over the fixing belt.

20 Claims, 10 Drawing Sheets

(56) References Cited

U.S. PATENT DOCUMENTS

| | | | | |
|---|---|---|---|---|
| 2014/0079453 | A1 | 3/2014 | Arai et al. | |
| 2014/0270831 | A1 | 9/2014 | Yoshinaga et al. | |
| 2014/0270832 | A1 | 9/2014 | Saito et al. | |
| 2014/0270833 | A1 | 9/2014 | Yuasa et al. | |
| 2014/0286684 | A1 | 9/2014 | Takagi et al. | |
| 2014/0341623 | A1 | 11/2014 | Arai et al. | |
| 2014/0341624 | A1 | 11/2014 | Arai et al. | |
| 2014/0356038 | A1 | 12/2014 | Arai et al. | |
| 2015/0055993 | A1 | 2/2015 | Shoji | |
| 2015/0063884 | A1 | 3/2015 | Iwaya et al. | |
| 2015/0098738 | A1 | 4/2015 | Arai et al. | |
| 2015/0234330 | A1* | 8/2015 | Nakada ..... | G03G 15/2053 399/329 |
| 2015/0268597 | A1 | 9/2015 | Arai et al. | |
| 2016/0378027 | A1 | 12/2016 | Sawada et al. | |
| 2017/0010570 | A1 | 1/2017 | Fujimoto et al. | |

FOREIGN PATENT DOCUMENTS

| | | |
|---|---|---|
| JP | 2012-103608 | 5/2012 |
| JP | 2013-137470 | 7/2013 |
| JP | 2014-186211 | 10/2014 |
| JP | 2015-064560 | 4/2015 |
| JP | 2015-145950 | 8/2015 |

* cited by examiner

FIXING DEVICE AND IMAGE FORMING APPARATUS

CROSS-REFERENCE TO RELATED APPLICATIONS

This patent application is based on and claims priority pursuant to 35 U.S.C. § 119 to Japanese Patent Application Nos. 2016-034112, filed on Feb. 25, 2016, and 2016-203426, filed on Oct. 17, 2016, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved fixing device. In one exemplary embodiment, the fixing device includes a fixing belt being endless and rotatable in a rotation direction. A primary heater, disposed opposite an inner circumferential surface of the fixing belt, heats the fixing belt. The primary heater includes a center heat generator disposed opposite a center span of the fixing belt in an axial direction of the fixing belt. A secondary heater, disposed opposite the inner circumferential surface of the fixing belt, heats the fixing belt. The secondary heater includes a lateral end heat generator disposed opposite a lateral end span of the fixing belt in the axial direction of the fixing belt. A nip formation pad is disposed opposite the inner circumferential surface of the fixing belt. An opposed rotator presses against the nip formation pad via the fixing belt to form a fixing nip between the fixing belt and the opposed rotator, through which a recording medium bearing a toner image is conveyed. The nip formation pad includes a base and at least one thermal conductor being interposed between the base and the fixing nip and having a thermal conductivity greater than a thermal conductivity of the base. The at least one thermal conductor includes an outboard edge disposed between an inboard edge and an outboard edge of the lateral end heat generator in the axial direction of the fixing belt and disposed outboard from a conveyance span of the fixing belt in the axial direction of the fixing belt, where the recording medium is conveyed over the fixing belt.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a fixing belt being endless and rotatable in a rotation direction. A primary heater, disposed opposite an inner circumferential surface of the fixing belt, heats the fixing belt. The primary heater includes a center heat generator disposed opposite a center span of the fixing belt in an axial direction of the fixing belt. A secondary heater, disposed opposite the inner circumferential surface of the fixing belt, heats the fixing belt. The secondary heater includes a lateral end heat generator disposed opposite a lateral end span of the fixing belt in the axial direction of the fixing belt. A nip formation pad is disposed opposite the inner circumferential surface of the fixing belt. An opposed rotator presses against the nip formation pad via the fixing belt to form a fixing nip between the fixing belt and the opposed rotator, through which the recording medium bearing the toner image is conveyed. The nip formation pad includes a base and at least one thermal conductor being interposed between the base and the fixing nip and having a thermal conductivity greater than a thermal conductivity of the base. The at least one thermal conductor includes an outboard edge disposed between an inboard edge and an outboard edge of the lateral end heat generator in the axial direction of the fixing belt and disposed outboard from a conveyance span of the fixing belt in the axial direction of the fixing belt, where the recording medium is conveyed over the fixing belt.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
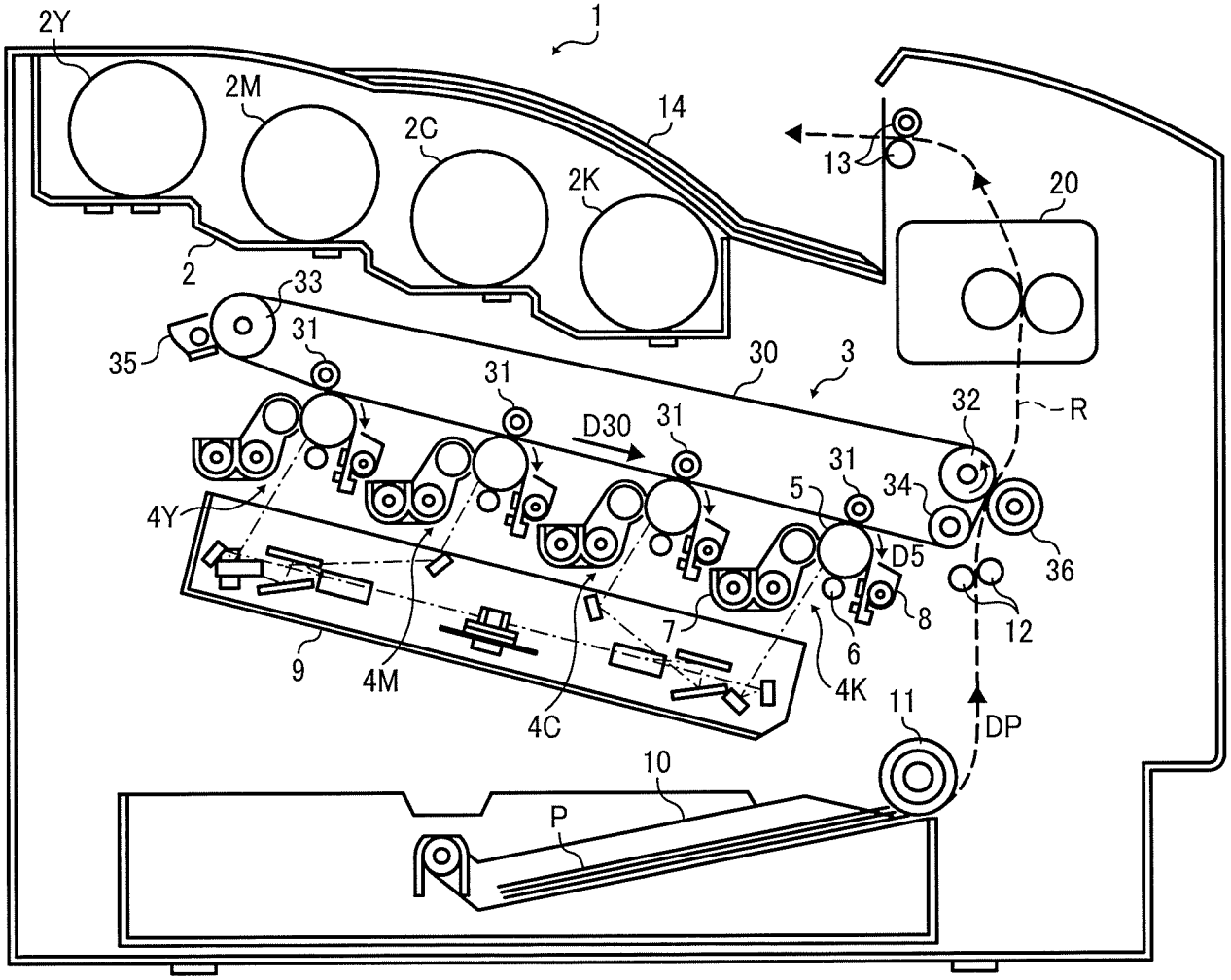
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an exemplary embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms color and monochrome toner images on a recording medium by electrophotography. Alternatively, the image forming apparatus 1 may be a monochrome printer that forms a monochrome toner image on a recording medium.

In the drawings for explaining exemplary embodiments of this disclosure, identical reference numerals are assigned as long as discrimination is possible to components such as members and component parts having an identical function or shape, thus omitting a description thereof once the description is provided.

Referring to FIG. 1, a description is provided of a construction of the image forming apparatus 1.

As illustrated in FIG. 1, the image forming apparatus 1 is a color laser printer including four image forming devices 4Y, 4M, 4C, and 4K situated in a center portion thereof. Although the image forming devices 4Y, 4M, 4C, and 4K contain developers (e.g., yellow, magenta, cyan, and black toners) in different colors, that is, yellow, magenta, cyan, and black corresponding to color separation components of a color image, respectively, the image forming devices 4Y, 4M, 4C, and 4K have an identical structure.

For example, each of the image forming devices 4Y, 4M, 4C, and 4K includes a drum-shaped photoconductor 5 serving as an image bearer or a latent image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. FIG. 1 illustrates reference numerals assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply that applies at least one of a predetermined direct current (DC) voltage and a predetermined alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is coupled to the power supply that applies at least one of a predetermined direct current (DC) voltage and a predetermined alternating current (AC) voltage thereto.

The belt cleaner 35 includes a cleaning brush and a cleaning blade that contact an outer circumferential surface of the intermediate transfer belt 30. A waste toner drain tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached to the bottle holder 2. The toner bottles 2Y, 2M, 2C, and 2K contain fresh yellow, magenta, cyan, and black toners to be supplied to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction DP. The registration roller pair 12 serving as a timing roller pair conveys the sheet P conveyed from the feed roller 11 toward the secondary transfer nip at a proper time.

The conveyance path R is further provided with a fixing device 20 (e.g., a fuser or a fusing unit) located above the secondary transfer nip, that is, downstream from the secondary transfer nip in the sheet conveyance direction DP. The fixing device 20 fixes an unfixed toner image transferred from the intermediate transfer belt 30 onto the sheet P conveyed from the secondary transfer nip on the sheet P. The conveyance path R is further provided with the output roller pair 13 located above the fixing device 20, that is, downstream from the fixing device 20 in the sheet conveyance direction DP. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4M, 4C, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constructing color image data sent from the external device, respectively, thus forming electrostatic latent images on the photoconductors 5. The image data used to expose the respective photoconductors 5 is monochrome image data produced by decomposing a desired full color image into yellow, magenta, cyan, and black image data. The developing devices 7 supply yellow, magenta, cyan, and black toners to the electrostatic latent images formed on the photoconductors 5, visualizing the electrostatic latent images as yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at the respective primary transfer nips formed between the photoconductors 5 and the primary transfer rollers 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 through the conveyance path R. The registration roller pair 12 temporarily halts the sheet P conveyed through the conveyance path R.

Thereafter, the registration roller pair 12 resumes rotation at a predetermined time to convey the sheet P to the secondary transfer nip at a time when the full color toner image formed on intermediate transfer belt 30 reaches the secondary transfer nip. The secondary transfer roller 36 is applied with a transfer voltage having a polarity opposite a polarity of the charged yellow, magenta, cyan, and black toners of the yellow, magenta, cyan, and black toner images constructing the full color toner image formed on the intermediate transfer belt 30, thus creating a transfer electric field at the secondary transfer nip. The transfer electric field secondarily transfers the yellow, magenta, cyan, and black toner images constructing the full color toner image formed on the intermediate transfer belt 30 onto the sheet P collectively. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into the waste toner container.

Thereafter, the sheet P bearing the full color toner image is conveyed to the fixing device 20 that fixes the full color toner image on the sheet P. Then, the sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4M, 4C, and 4K or may form a bicolor toner image or a tricolor toner image by using two or three of the image forming devices 4Y, 4M, 4C, and 4K.

Figure 2:
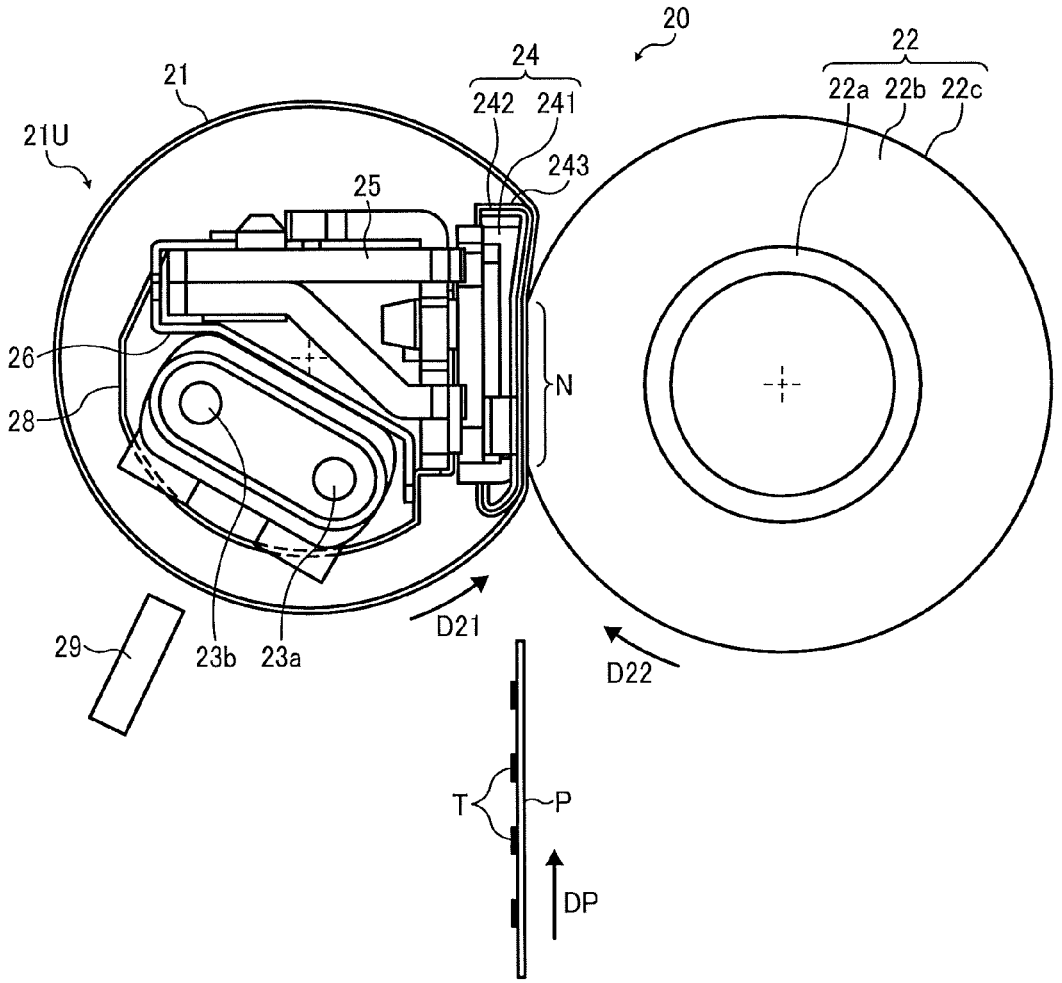
FIG. 2 is a vertical cross-sectional view of a fixing device incorporated in the image forming apparatus depicted in FIG. 1.

Referring to FIG. 2, a description is provided of a construction of the fixing device 20 incorporated in the image forming apparatus 1 having the construction described above.

FIG. 2 is a schematic vertical cross-sectional view of the fixing device 20. As illustrated in FIG. 2, the fixing device 20 (e.g., a fuser or a fusing unit) includes a fixing belt 21, a pressure roller 22, two halogen heaters 23*a* and 23*b*, a nip formation pad 24, a stay 25, a reflector 26, a stationary shield 28, and a temperature sensor 29. The fixing belt 21 formed into a loop serves as a fixing rotator or an endless belt rotatable in a rotation direction D21. The pressure roller 22 serves as an opposed rotator or a pressure rotator that is rotatable in a rotation direction D22 and disposed opposite an outer circumferential surface of the fixing belt 21. The two halogen heaters 23*a* and 23*b* serve as a heater or a heat source that heats the fixing belt 21. The nip formation pad 24 is disposed opposite an inner circumferential surface of the fixing belt 21. The stay 25 serves as a support that supports the nip formation pad 24. The reflector 26 reflects light or heat (e.g., radiant heat) radiated from the halogen heaters 23*a* and 23*b* to the fixing belt 21. The stationary shield 28 shields the fixing belt 21 from light or heat radiated from at least one of the halogen heaters 23*a* and 23*b* to the fixing belt 21. According to this exemplary embodiment, the stationary shield 28 shields the fixing belt 21 from light or heat radiated from the halogen heater 23*b* having a heat generator disposed at each lateral end of the halogen heater 23*b* in a longitudinal direction thereof. The temperature sensor 29 serves as a temperature detector that detects the temperature of the outer circumferential surface of the fixing belt 21.

The fixing belt 21 and the components disposed inside the loop formed by the fixing belt 21, that is, the halogen heaters 23*a* and 23*b*, the nip formation pad 24, the stay 25, the reflector 26, and the stationary shield 28, may construct a belt unit 21U separably coupled with the pressure roller 22.

A detailed description is now given of a construction of the fixing belt 21.

The fixing belt 21 is a thin, flexible endless belt or film. For example, the fixing belt 21 is constructed of a base layer serving as the inner circumferential surface of the fixing belt 21 and a release layer serving as the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves fixing property of being heated quickly to a predetermined fixing temperature at which a toner image T is fixed on a sheet P. However, as the pressure roller 22 and the fixing belt 21 sandwich and press the unfixed toner image T on the sheet P passing through a fixing nip N formed between the fixing belt 21 and the pressure roller 22, slight surface asperities of the fixing belt 21 may be transferred onto the toner image T on the sheet P, resulting in variation in gloss of the solid toner image T. To address this circumstance, the fixing belt 21 incorporates the elastic layer having a thickness not smaller than 100 micrometers. The elastic layer having the thickness not smaller than 100 micrometers elastically deforms to absorb slight surface asperities of the fixing belt 21, preventing variation in gloss of the toner image T on the sheet P.

In order to decrease the thermal capacity of the fixing belt 21, the fixing belt 21 is thin and has a decreased loop diameter. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. Thus, the fixing belt 21 has a total thickness not greater than 1 mm. A loop diameter of the fixing belt 21 is in a range of from 20 mm to 40 mm. In order to decrease the thermal capacity of the fixing belt 21 further, the fixing belt 21 may have a total thickness not greater than 0.20 mm and preferably not greater than 0.16 mm.

A detailed description is now given of a construction of the pressure roller 22.

The pressure roller 22 is constructed of a core bar 22*a*; an elastic layer 22*b* coating the core bar 22*a* and made of rubber such as silicone rubber foam, silicone rubber, and fluoro rubber; and a release layer 22*c* coating the elastic layer 22*b* and made of PFA, PTFE, or the like. A pressurization assembly presses the pressure roller 22 against the nip formation pad 24 via the fixing belt 21. The pressure roller 22 pressingly contacting the fixing belt 21 deforms the elastic layer 22*b* of the pressure roller 22 at the fixing nip N formed between the pressure roller 22 and the fixing belt 21, thus defining the fixing nip N having a predetermined length in the sheet conveyance direction DP.

A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the pressure roller 22 and the fixing belt 21. Alternatively, the driver may also be connected to the fixing belt 21 to drive and rotate the fixing belt 21.

According to this exemplary embodiment, the pressure roller 22 is a solid roller. Alternatively, the pressure roller 22 may be a hollow roller. In this case, a heater such as a halogen heater may be disposed inside the hollow roller. The elastic layer 22*b* may be made of solid rubber. Alternatively, if no heater is situated inside the pressure roller 22, the elastic layer 22*b* may be made of sponge rubber. The sponge rubber is more preferable than the solid rubber because the sponge rubber has an increased insulation that draws less heat from the fixing belt 21.

A detailed description is now given of a configuration of the halogen heaters 23*a* and 23*b*.

The halogen heaters 23*a* and 23*b* are disposed opposite the inner circumferential surface of the fixing belt 21. The halogen heaters 23*a* and 23*b* heat a heating span of the fixing belt 21 directly. The heating span is other than or disposed outboard from the fixing nip N in a circumferential direction, that is, the rotation direction D21, of the fixing belt 21. According to this exemplary embodiment, the heating span of the fixing belt 21 is a direct heating span of the fixing belt 21 that is disposed upstream from the fixing nip N in the rotation direction D21 of the fixing belt 21 or the sheet conveyance direction DP. The halogen heaters 23*a* and 23*b* are disposed opposite the direct heating span of the fixing belt 21 directly to heat the fixing belt 21 directly.

The power supply situated inside the image forming apparatus 1 supplies power to the halogen heaters 23*a* and 23*b* so that the halogen heaters 23*a* and 23*b* heat the fixing belt 21. A controller (e.g., a processor), that is, a central processing unit (CPU) provided with a random-access memory (RAM) and a read-only memory (ROM), for example, operatively connected to the halogen heaters 23*a* and 23*b* and the temperature sensor 29 controls the halogen heaters 23*a* and 23*b* based on the temperature of the outer circumferential surface of the fixing belt 21 that is detected by the temperature sensor 29. Thus, the controller adjusts the temperature of the fixing belt 21 to a desired fixing temperature. Instead of the temperature sensor 29 that detects the temperature of the fixing belt 21, a temperature sensor that detects the temperature of the pressure roller 22 may be disposed opposite the pressure roller 22 so that the temperature of the fixing belt 21 is estimated based on a temperature of the pressure roller 22 that is detected by the temperature sensor.

When the fixing device 20 receives a fixing job to fix an unfixed toner image T on a sheet P, the driver drives and rotates the pressure roller 22 which in turn rotates the fixing belt 21 by friction therebetween. One or both of the halogen heaters 23*a* and 23*b* generate heat that heats the fixing belt 21. When the temperature of the fixing belt 21 reaches the desired fixing temperature, the sheet P is conveyed through the fixing nip N. While the sheet P is conveyed through the fixing nip N, the fixing belt 21 and the pressure roller 22 fix the toner image T on the sheet P under heat and pressure.

According to this exemplary embodiment, the fixing device 20 incorporates the two halogen heaters 23*a* and 23*b*. Alternatively, the fixing device 20 may incorporate three or more halogen heaters according to the sizes of the sheets P or the like that are available in the image forming apparatus 1. Alternatively, instead of the halogen heaters 23*a* and 23*b*, a carbon heater or the like may be employed as a heater that heats the fixing belt 21 with radiant heat.

A detailed description is now given of a construction of the nip formation pad 24.

The nip formation pad 24 is disposed inside the loop formed by the fixing belt 21 and disposed opposite the pressure roller 22 via the fixing belt 21. The nip formation pad 24 includes a base 241 and a thermal conductor 242. For example, the base 241 is made of heat resistant resin such as polyether sulfone (PES), polyphenylene sulfide (PPS), liquid crystal polymer (LCP), polyether nitrile (PEN), polyamide imide (PAI), polyether ether ketone (PEEK), or the like. The thermal conductor 242 is made of a material having a thermal conductivity greater than a thermal conductivity of the base 241. For example, the thermal conductor 242 is made of carbon nanotube having a theimal conductivity in a range of from 3,000 W/mK to 5,500 W/mK, graphite sheet having a thermal conductivity in a range of from 700 W/mK to 1,750 W/mK, silver having a thermal conductivity of 420 W/mK, copper having a thermal conductivity of 398 W/mK, aluminum having a thermal conductivity of 236 W/mK, steel electrolytic cold commercial (SECC), or the like. The thermal conductor 242 has a thermal conductivity not smaller than 236 W/mK.

The thermal conductor 242 is sandwiched between the base 241 and the fixing belt 21 at the fixing nip N. In other words, the base 241 is disposed opposite the fixing nip N via the thermal conductor 242.

A detailed description is now given of a configuration of the stay 25.

The stay 25 supports the base 241. Accordingly, even if the nip formation pad 24 receives pressure from the pressure roller 22, the nip formation pad 24 is not bent by the pressure and therefore produces a uniform nip length of the fixing nip N in the sheet conveyance direction DP throughout the entire width of the fixing belt 21 and the pressure roller 22 in an axial direction thereof. The stay 25 is made of metal having an increased mechanical strength, such as steel (e.g., stainless steel), to prevent bending of the nip formation pad 24. Alternatively, the stay 25 may be made of resin having a mechanical strength great enough to prevent bending of the nip formation pad 24.

A nip side face of the thermal conductor 242 is attached with a low-friction sheet 243. As the fixing belt 21 rotates in the rotation direction D21, the inner circumferential surface of the fixing belt 21 slides over the low-friction sheet 243 that reduces friction between the fixing belt 21 and the nip formation pad 24. Alternatively, the low-friction sheet 243 may be omitted.

A detailed description is now given of a configuration of the reflector 26.

The reflector 26 is interposed between the stay 25 and the halogen heaters 23*a* and 23*b*. The reflector 26 is secured to and supported by the stay 25. The reflector 26 reflects heat or light radiated from the halogen heaters 23*a* and 23*b* toward the fixing belt 21, suppressing conduction of heat from the halogen heaters 23*a* and 23*b* to the stay 25 and the like and thereby heating the fixing belt 21 effectively and saving energy. The reflector 26 is made of aluminum, stainless steel, or the like. If the reflector 26 is constructed of an aluminum base treated with vapor deposition of silver having a decreased emissivity and an increased reflectance, the reflector 26 enhances heating efficiency in heating the fixing belt 21.

A detailed description is now given of a configuration of the stay 25.

The stationary shield 28 is secured to the stay 25. The stationary shield 28 is disposed opposite the inner circumferential surface of the fixing belt 21 at each lateral end of the fixing belt 21 in the axial direction thereof. The stationary shield 28 is disposed opposite the halogen heaters 23*a* and 23*b* to shield the fixing belt 21 from the halogen heater 23*b*. Since the stationary shield 28 is requested to be heat resistant, the stationary shield 28 is made of metal such as aluminum, iron, and stainless steel or ceramics.

A description is provided of a configuration of a plurality of belt holders 40.

Figure 3:
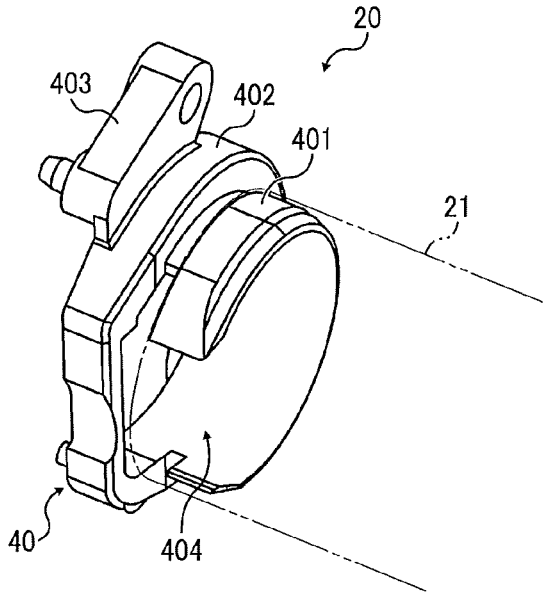
FIG. 3 is a partial perspective view of the fixing device depicted in FIG. 2, illustrating one of belt holders incorporated therein.

FIG. 3 is a partial perspective view of the fixing device 20, illustrating one of the plurality of belt holders 40. The fixing device 20 further includes the plurality of belt holders 40 disposed opposite the inner circumferential surface of the fixing belt 21 at both lateral ends of the fixing belt 21 in the axial direction thereof, respectively. The belt holders 40 rotatably support the fixing belt 21 at both lateral ends of the fixing belt 21 in the axial direction thereof. Basically, no other component supports the fixing belt 21. That is, the fixing belt 21 is not looped over or stretched taut across a roller or the like. The pair of belt holders 40, the halogen heaters 23*a* and 23*b*, and the stay 25 depicted in FIG. 2 are secured to and supported by a pair of side plates of the fixing device 20 that is disposed at both lateral ends of the fixing device 20 in the axial direction of the fixing belt 21, respectively.

Figure 4:
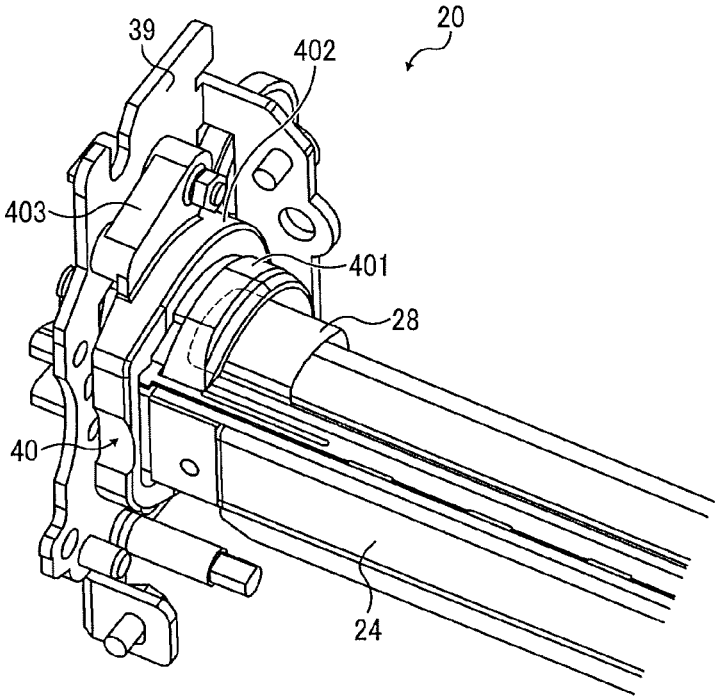
FIG. 4 is a perspective view of the fixing device depicted in FIG. 2, illustrating one lateral end of the fixing device in a longitudinal direction thereof.

FIG. 4 is a perspective view of the fixing device 20, illustrating one lateral end of the fixing device 20 in the axial direction of the fixing belt 21. As illustrated in FIGS. 3 and 4, the belt holder 40 includes a holding portion 401, a restricting portion 402, a mounted portion 403, and a slit 404. As illustrated in FIG. 3, the holding portion 401 is disposed inside the loop formed by the fixing belt 21 to rotatably support the fixing belt 21. The restricting portion 402 restricts skew of the fixing belt 21 in the axial direction thereof. As illustrated in FIG. 4, the mounted portion 403 is mounted on and secured to a side plate 39 of the fixing device 20 with a fastener such as a screw. As illustrated in FIG. 3, the holding portion 401 is provided with the slit 404 at a part of the holding portion 401 in the circumferential direction of the fixing belt 21 and is partially cylindrical or tubular. As the holding portion 401 is inserted into an interior inside the loop formed by the fixing belt 21 at each lateral end of the fixing belt 21 in the axial direction thereof, the holding portion 401 rotatably supports the fixing belt 21. Although FIG. 3 illustrates the belt holder 40 situated at one lateral end of the fixing belt 21 in the axial direction thereof, the belt holder 40 is also situated at another lateral end of the fixing belt 21 in the axial direction thereof.

After the fixing device 20 is assembled, each lateral end of the nip formation pad 24 in a longitudinal direction thereof is disposed in the slit 404 of the holding portion 401. As illustrated in FIG. 4, the stationary shield 28 is disposed opposite an inner circumferential surface of the holding portion 401. The stationary shield 28 shields the belt holder 40 from the halogen heaters 23*a* and 23*b*, preventing the belt holder 40 from being overheated by the halogen heaters 23*a* and 23*b* and thereby preventing the belt holder 40 from being deformed thermally and broken.

As illustrated in FIG. 3, the restricting portion 402 is greater than at least an outer loop diameter of the fixing belt 21. The restricting portion 402 is disposed opposite a lateral edge face of the fixing belt 21 in the axial direction thereof. If the fixing belt 21 is skewed in the axial direction thereof while the fixing belt 21 rotates, the lateral edge face of the fixing belt 21 comes into contact with the restricting portion 402 which restricts skew of the fixing belt 21.

A description is provided of a construction of the halogen heaters 23*a* and 23*b*.

Figure 5:
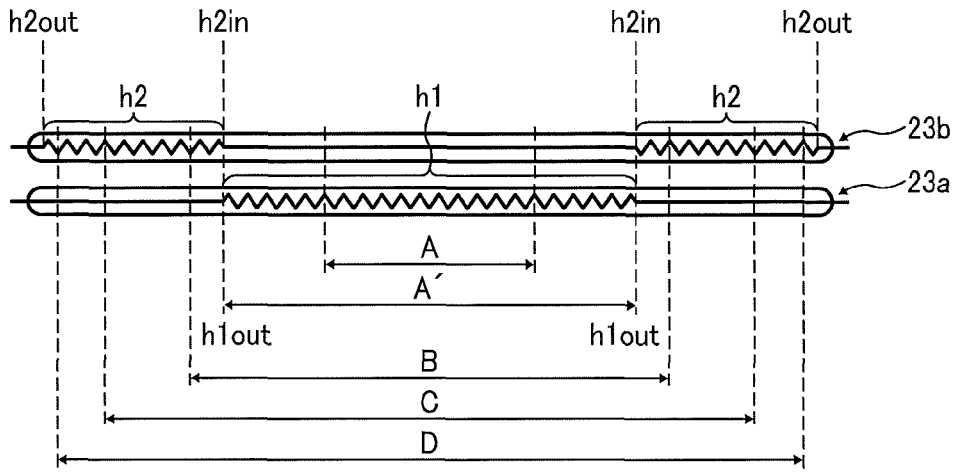
FIG. 5 is a diagram of halogen heaters incorporated in the fixing device depicted in FIG. 2, illustrating arrangement of the halogen heaters.

FIG. 5 is a diagram of the halogen heaters 23*a* and 23*b*, illustrating arrangement of the halogen heaters 23*a* and 23*b*. As illustrated in FIG. 5, the two halogen heaters 23*a* and 23*b* have different heat generation spans in a longitudinal direction of the halogen heaters 23*a* and 23*b* parallel to the axial direction of the fixing belt 21, respectively. The halogen heater 23*a* is a center heater serving as a primary heater that includes a heat generator h1 (e.g., an illuminator) disposed opposite a center span of the fixing belt 21 in the axial direction thereof. The halogen heater 23*b* is a lateral end heater serving as a secondary heater that includes a heat generator h2 (e.g., an illuminator) disposed opposite each lateral end span of the fixing belt 21 in the axial direction thereof. An inboard edge h2in of the heat generator h2 of the halogen heater 23*b* in the longitudinal direction thereof, which corresponds to a lateral edge of the center span of the fixing belt 21 in the axial direction thereof, is disposed opposite or corresponds to a lateral edge h1 out of the heat generator h1 of the halogen heater 23*a* in the longitudinal direction thereof.

A conveyance span A corresponds to a width of a postcard in the axial direction of the fixing belt 21. A conveyance span A' corresponds to a width of an A4 size sheet in portrait orientation in the axial direction of the fixing belt 21. A conveyance span B corresponds to a width of a B4 size sheet in portrait orientation in the axial direction of the fixing belt 21. A conveyance span C corresponds to a width of an A3 size sheet in portrait orientation in the axial direction of the fixing belt 21. A conveyance span D corresponds to a width of an A3 extension size sheet in the axial direction of the fixing belt 21. When the postcard is conveyed over the fixing belt 21 in the conveyance span A or the A4 size sheet in portrait orientation is conveyed over the fixing belt 21 in the conveyance span A', the halogen heater 23*a* is energized to cause the heat generator h1 disposed opposite the center span of the fixing belt 21 in the axial direction thereof to generate heat. Conversely, when the B4 size sheet in portrait orientation is conveyed over the fixing belt 21 in the conveyance span B, the A3 size sheet in portrait orientation is conveyed over the fixing belt 21 in the conveyance span C, or the A3 extension size sheet is conveyed over the fixing belt 21 in the conveyance span D, the halogen heaters 23*a* and 23*b* are energized to cause the heat generator h1 disposed opposite the center span of the fixing belt 21 in the axial direction thereof and the heat generators h2 disposed opposite both lateral end spans of the fixing belt 21 in the axial direction thereof, respectively, to generate heat.

A description is provided of a configuration of a comparative fixing device.

The comparative fixing device includes a fixing belt and a heater that heats the fixing belt.

As the comparative fixing device is configured to fix a toner image on sheets of an increased number of sizes, the number of conveyance spans where the sheets are conveyed over the fixing belt increases. If the number of heaters installed in the comparative fixing device increases to address this circumstance, the comparative fixing device may be manufactured at increased costs or may be upsized. To address this circumstance, the comparative fixing device decreases the number of heaters installed therein.

However, a plurality of heating spans of the fixing belt that is heated by the decreased number of heaters may not correspond to a plurality of sizes of sheets. Accordingly, the fixing belt may overheat in a non-conveyance span where the sheets are not conveyed over the fixing belt. The fixing belt is more susceptible to overheating than a fixing roller because a thermal capacity of the fixing belt is smaller than a thermal capacity of the fixing roller.

To address this circumstance, the comparative fixing device may include a thermal conductor that diffuses heat from the non-conveyance span of the fixing belt that is susceptible to overheating.

The thermal conductor prevents overheating of the non-conveyance span of the fixing belt, allowing the decreased number of heaters to heat the plurality of heating spans of the fixing belt that corresponds the increased number of sizes of sheets.

However, if the thermal conductor is excessively long, a thermal capacity of the thermal conductor may increase and the thermal conductor may diffuse heat excessively. Accordingly, when a large sheet is conveyed over the fixing belt, the fixing belt may not heat each lateral end of the large sheet sufficiently or the fixing belt may be heated slowly, degrading productivity (e.g., a fixing speed to complete a fixing job) of the comparative fixing device. Conversely, if the thermal conductor is excessively short, the thermal conductor may not diffuse heat sufficiently, causing overheating of the non-conveyance span of the fixing belt.

A description is provided of a configuration of the fixing device 20 to address overheating in a non-conveyance span of the fixing belt 21 where sheets P are not conveyed over the fixing belt 21 installed in the fixing device 20 having a decreased number of heaters (e.g., the halogen heaters 23*a* and 23*b*) relative to an increased number of sizes of the sheets P.

As illustrated in FIG. 5, an outboard edge h2out of the heat generator h2 in the longitudinal direction of the halogen heater 23*b* is disposed outboard from the conveyance span B in the longitudinal direction of the halogen heater 23*b*. Accordingly, when a sheet P is conveyed over the conveyance span B, an outboard span being outboard from the conveyance span B in the axial direction of the fixing belt 21 is the non-conveyance span where the sheet P is not conveyed over the fixing belt 21. Although the heat generator h2 heats the non-conveyance span of the fixing belt 21, the sheet P conveyed in the conveyance span B of the fixing belt 21 does not draw heat from the non-conveyance span of the fixing belt 21, resulting in overheating of the non-conveyance span of the fixing belt 21. To address this circumstance, the fixing device 20 incorporates the thermal conductor 242 having an enhanced thermal conductivity to diffuse heat in the axial direction of the fixing belt 21.

A description is provided of a referential configuration of the fixing device 20 incorporating the nip formation pad 24 that includes the thermal conductor 242 having the enhanced thermal conductivity.

Figure 6:
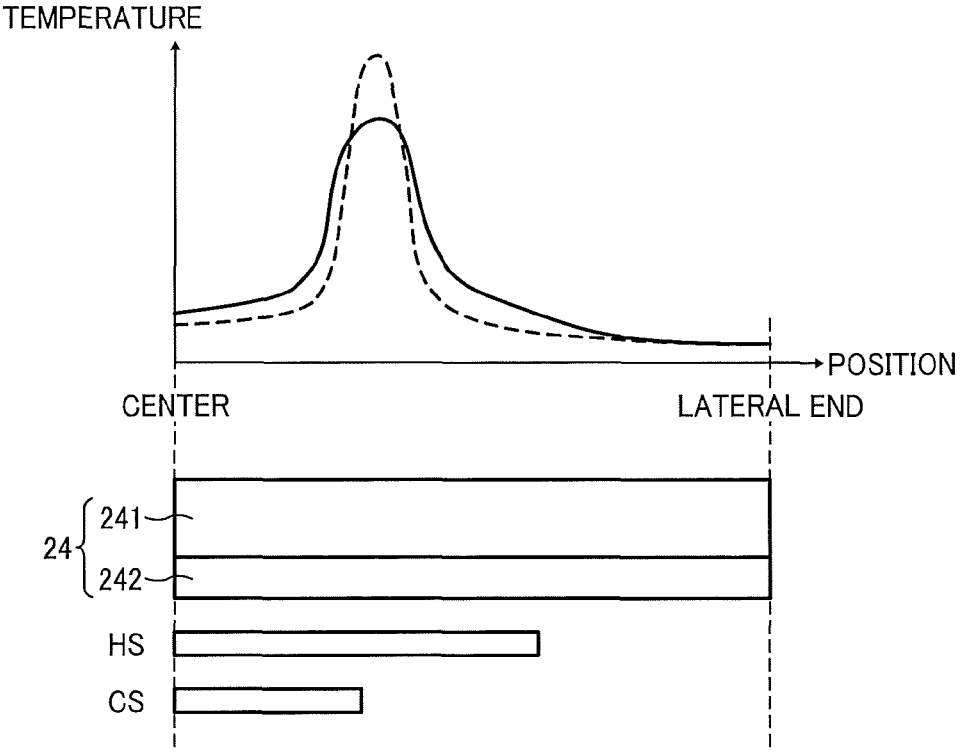
FIG. 6 is a graph illustrating a relation between a position on a nip formation pad incorporated in the fixing device depicted in FIG. 2 and a temperature of a fixing belt incorporated in the fixing device depicted in FIG. 2.

FIG. 6 is a graph illustrating a relation between the position on the nip formation pad 24 in the longitudinal direction thereof and the temperature of the fixing belt 21. As illustrated in FIG. 6, the nip formation pad 24 includes the base 241 and the thermal conductor 242 situated below the base 241 in FIG. 6. The base 241 is disposed opposite the fixing nip N via the thermal conductor 242. A thermal conductivity of the thermal conductor 242 is greater than a thermal conductivity of the base 241. FIG. 6 illustrates a cross-section of the nip formation pad 24 in a half span of the nip formation pad 24 defined from a center to one lateral end of the nip formation pad 24 in the axial direction of the fixing belt 21. Like the fixing device 20 depicted in FIG. 2, the referential configuration of the fixing device 20 involves the fixing belt 21, the pressure roller 22, the halogen heaters 23*a* and 23*b*, and the like in addition to the nip formation pad 24.

The non-conveyance span of the fixing belt 21 overheats if the width of the sheet P is shorter than a heat generation span defined by the heat generators h1 and h2 in the axial direction of the fixing belt 21. With a relation between a heat generation span HS defined by the heat generators h1 and h2 and a conveyance span CS where the sheet P is conveyed over the fixing belt 21 as illustrated in FIG. 6, if the nip formation pad 24 does not incorporate the thermal conductor 242, as indicated by a dotted line, the fixing belt 21 overheats in the non-conveyance span being outboard from the conveyance span CS in the axial direction of the fixing belt 21 at a position in proximity to the conveyance span CS. Conversely, with the relation between the heat generation span HS and the conveyance span CS as illustrated in FIG. 6, if the nip formation pad 24 incorporates the thermal conductor 242, as indicated by a solid line, the thermal conductor 242 diffuses heat applied to the fixing belt 21 in the axial direction thereof, suppressing overheating of the non-conveyance span of the fixing belt 21.

The thermal conductor 242 suppresses overheating of the non-conveyance span of the fixing belt 21 where the sheet P is not conveyed. The longer the thermal conductor 242 is in the axial direction of the fixing belt 21, the more the thermal conductor 242 suppresses overheating of the fixing belt 21. However, if the thermal conductor 242 is excessively long in the axial direction of the fixing belt 21, each lateral end of the fixing belt 21 in the axial direction thereof may have a temperature lower than a desired temperature immediately after the fixing device 20 is powered on.

Figure 7:
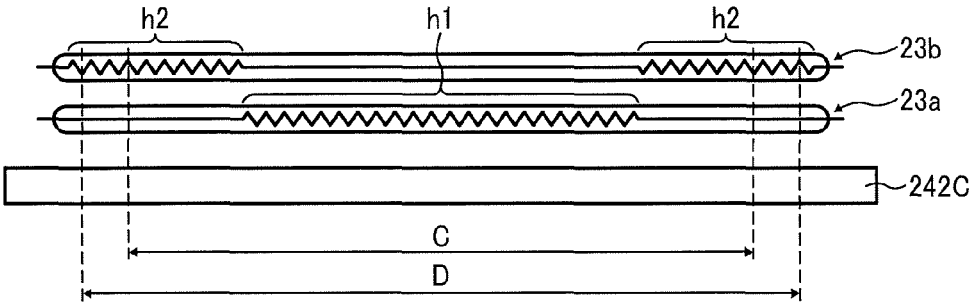
FIG. 7 is a diagram of the halogen heaters depicted in FIG. 5 and a comparative thermal conductor that is elongated.

FIG. 7 is a diagram of the halogen heaters 23*a* and 23*b* and a comparative thermal conductor 242C that is elongated in the axial direction of the fixing belt 21. In order to suppress overheating of the fixing belt 21 effectively in the non-conveyance span being outboard from the conveyance span C where the A3 size sheet in portrait orientation is conveyed, the comparative thermal conductor 242C extends to a position being outboard from the heat generator h2 of the halogen heater 23*b* in the longitudinal direction thereof. However, in a fixing job to fix a toner image T on an A3 extension size sheet, that is, a maximum size sheet available in the fixing device 20, conveyed in the conveyance span D, the fixing belt 21 may suffer from temperature decrease at each lateral end of the conveyance span D in the axial direction of the fixing belt 21. For example, an outboard end of each of the heat generators h2 of the halogen heater 23*b* in the longitudinal direction thereof generates a decreased amount of heat.

The comparative thermal conductor 242C, which extends to a position being outboard from the outboard end of each of the heat generators h2, may diffuse an increased amount of heat outward in the axial direction of the fixing belt 21. Accordingly, the fixing belt 21 may not store heat sufficiently. If the fixing belt 21 suffers from temperature decrease, the fixing belt 21 may degrade productivity (e.g., a fixing speed to complete a fixing job) of the fixing device 20. In order to improve productivity, the heat generator h2 may be elongated outward in the longitudinal direction of the halogen heater 23*b*. However, the elongated heat generator h2 may waste energy and upsize the fixing device 20.

Figure 8:
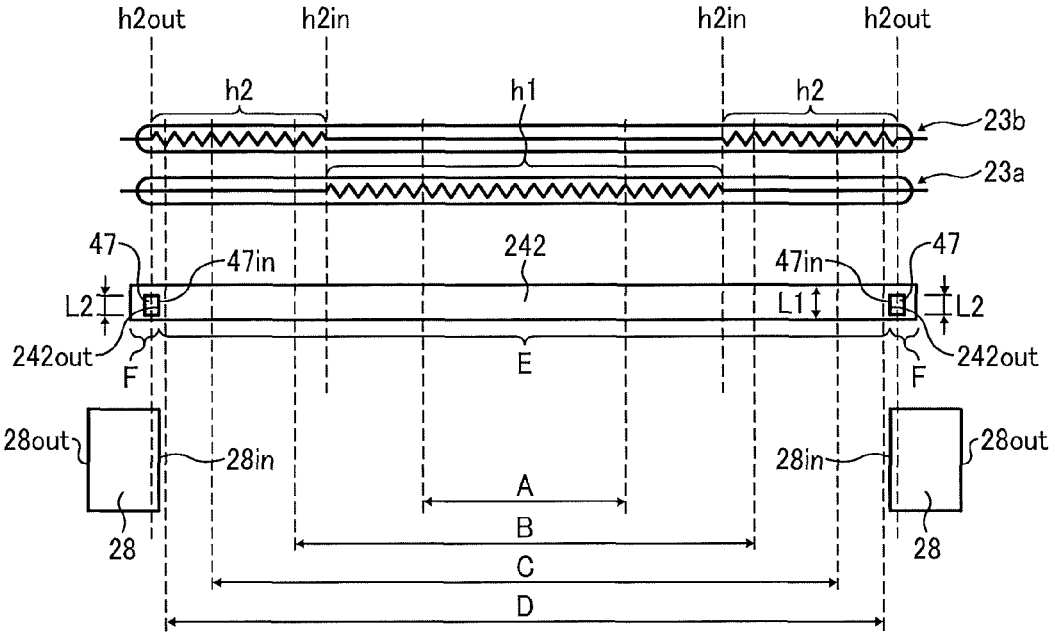
FIG. 8 is a diagram of the halogen heaters depicted in FIG. 7 and a thermal conductor incorporated in the fixing device depicted in FIG. 2 and provided with a slot.

To address those circumstances, the fixing device 20 has a configuration described below with reference to FIG. 8 to suppress overheating of the non-conveyance span of the fixing belt 21 where the sheet P is not conveyed while retaining productivity. FIG. 8 is a diagram of the halogen heaters 23*a* and 23*b* and the thermal conductor 242. In a description below, inboard denotes a position being closer to or situated at a center of the fixing belt 21 in the axial direction thereof; outboard denotes a position being closer to or situated at a lateral end of the fixing belt 21 in the axial direction thereof.

As illustrated in FIG. 8, a length of the thermal conductor 242 is defined such that each outboard edge 242out of the thermal conductor 242 is interposed between the inboard edge h2in and the outboard edge h2out of each of the heat generators h2 of the halogen heater 23*b* in the longitudinal direction thereof. The outboard edge 242out of the thermal conductor 242 defines an inboard edge 47in of a slot 47 abutting on each lateral end of the thermal conductor 242 in a longitudinal direction thereof.

Each slot 47 positions the thermal conductor 242 to the base 241 of the nip formation pad 24 depicted in FIG. 2. As a projection serving as a positioner projecting from the base 241 is inserted into each slot 47 disposed on the thermal conductor 242, the thermal conductor 242 is positioned relative to the base 241 in the longitudinal direction of the thermal conductor 242.

The slot 47 decreases an area where the thermal conductor 242 contacts the fixing belt 21, thus reducing heat conduction from a portion provided with the slot 47 outward in the longitudinal direction of the thermal conductor 242. For example, as illustrated in FIG. 8, a length L2 of the slot 47 in the sheet conveyance direction DP is not smaller than a half of a length L1 of the thermal conductor 242 in the sheet conveyance direction DP, decreasing the amount of heat conducted from the slot 47 outward in the longitudinal direction of the thermal conductor 242. The thermal conductor 242 has a center span E spanning from one slot 47 to another slot 47 through a center of the thermal conductor 242 in the longitudinal direction thereof. The center span E serves mainly as a thermal conduction span. Conversely, the thermal conductor 242 further has an outboard span F that is disposed outboard from the outboard edge 242out of the thermal conductor 242 in the longitudinal direction thereof or defined by the slot 47 and a portion disposed outboard from the slot 47 in the longitudinal direction of the thermal conductor 242. Although the outboard span F conducts heat slightly, the outboard span F achieves a decreased thermal conduction compared to the center span E. Hence, the outboard span F serves mainly as a positioning span.

Accordingly, a lateral edge of the center span E serving as the thermal conduction span of the thermal conductor 242 to conduct heat stored in the fixing belt 21 in the axial direction thereof, which corresponds to the inboard edge 47in of the slot 47 in the longitudinal direction of the thermal conductor 242, defines the outboard edge 242out of the thermal conductor 242 in the longitudinal direction thereof. Unlike the thermal conductor 242 according to this exemplary embodiment, if the length L2 of the slot 47 in the sheet conveyance direction DP is smaller than the half of the length L1 of the thermal conductor 242 in the sheet conveyance direction DP, the outboard span F, which is disposed outboard from the outboard edge 242out in the longitudinal direction of the thermal conductor 242 or defined by the slot 47 and the portion disposed outboard from the slot 47 in the longitudinal direction of the thermal conductor 242, also serves as the thermal conduction span. In this case, an outboard edge of the entire thermal conductor 242 in the longitudinal direction thereof, including the outboard span F defined by the slot 47 and the portion disposed outboard from the slot 47 in the longitudinal direction of the thermal conductor 242, defines the outboard edge 242out of the thermal conductor 242 in the longitudinal direction thereof.

An outboard edge 28out of the stationary shield 28 in the axial direction of the fixing belt 21 is disposed outboard from the outboard edge h2out of the heat generator h2 in the longitudinal direction of the halogen heater 23*b* and the center span E of the thermal conductor 242 in the longitudinal direction thereof. Since the stationary shield 28 is disposed outboard from the heat generator h2 in the axial direction of the fixing belt 21, the stationary shield 28 shields the fixing belt 21 from heat in an outboard span disposed outboard from the heat generator h2 in the longitudinal direction of the halogen heater 23*b*.

An inboard edge 28in of the stationary shield 28 in the axial direction of the fixing belt 21 is disposed outboard from the center span E of the thermal conductor 242 in the longitudinal direction thereof. The stationary shield 28 shields the outboard span of the fixing belt 21 that is disposed outboard from the center span E in the axial direction of the fixing belt 21 from heat generated by the heat generator h2. In other words, the center span E where the thermal conductor 242 conducts heat is disposed inboard from the outboard span of the fixing belt 21 in the axial direction thereof. Thus, the stationary shield 28 prevents heat from conducting to the outboard span of the fixing belt 21 unnecessarily, thus preventing waste of energy.

Figure 9:
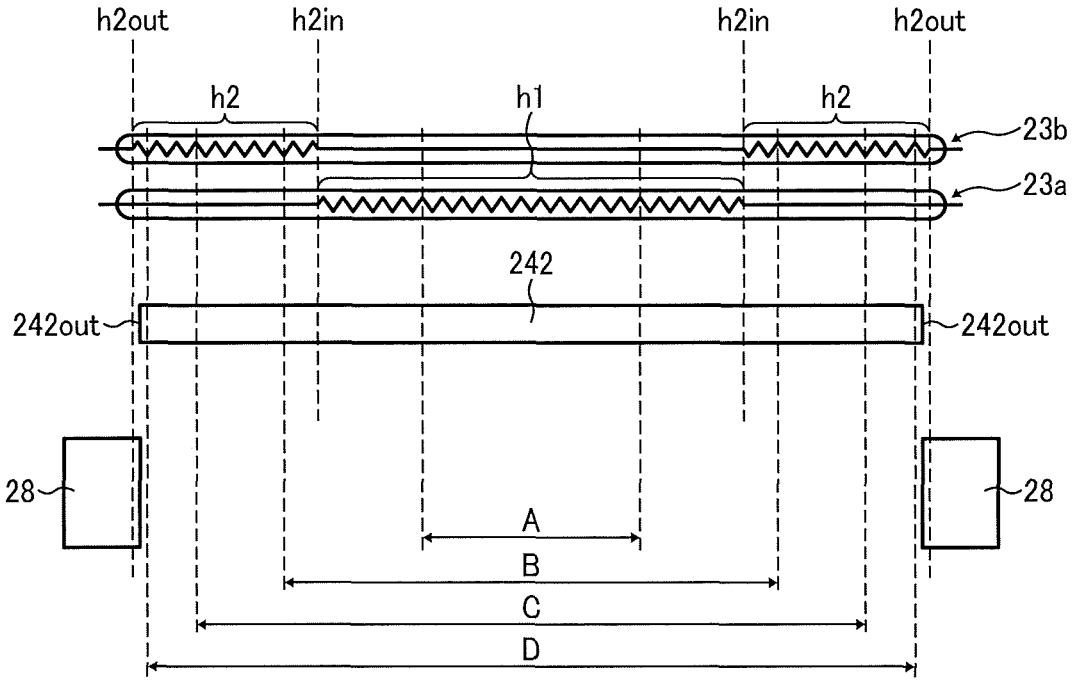
FIG. 9 is a diagram of the halogen heaters and the thermal conductor incorporated in the fixing device depicted in FIG. 2 and not provided with the slot.

Referring to FIG. 9, a description is provided of another configuration of the fixing device 20 to suppress overheating of the non-conveyance span of the fixing belt 21 where the sheet P is not conveyed while retaining productivity.

FIG. 9 is a diagram of the halogen heaters 23*a* and 23*b* and the thermal conductor 242. As illustrated in FIG. 9, unlike the thermal conductor 242 depicted in FIG. 8, the thermal conductor 242 depicted in FIG. 9 is not provided with the slots 47 serving as a positioner abutting on both lateral ends of the thermal conductor 242 in the longitudinal direction thereof, respectively. The thermal conductor 242 attains a uniform contact length in the sheet conveyance direction DP in which the thermal conductor 242 contacts the fixing belt 21 throughout the entire width of the thermal conductor 242 in the longitudinal direction thereof. Thus, the entire thermal conductor 242 serves as a thermal conduction span. Accordingly, as illustrated in FIG. 9, an outermost edge of the entire thermal conductor 242 in the longitudinal direction thereof defines the outboard edge 242out of the thermal conductor 242 in the longitudinal direction thereof.

A description is provided of the inboard edge h2in and the outboard edge h2out of the heat generator h2 of the halogen heater 23*b* in the longitudinal direction thereof.

Figure 10:
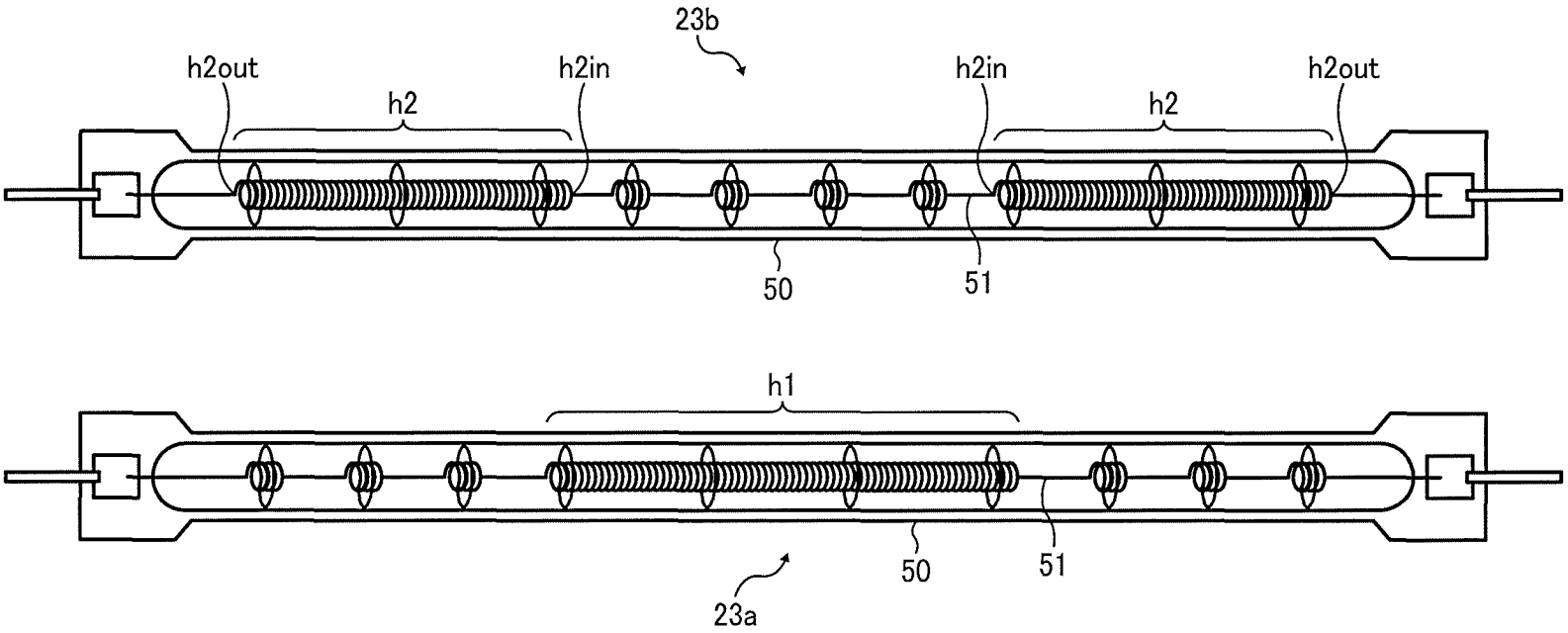
FIG. 10 is a perspective view of the halogen heaters depicted in FIG. 8.

FIG. 10 is a perspective view of the halogen heaters 23*a* and 23*b*. As illustrated in FIG. 10, each of the halogen heater 23*a* serving as the center heater and the halogen heater 23*b* serving as the lateral end heater includes a glass tube 50 that is tubular or cylindrical and a filament 51 serving as a heat generator disposed inside the glass tube 50. The filament 51 is coiled densely and continuously in the longitudinal direction of the halogen heaters 23*a* and 23*b* to define the heat generators h1 and h2. According to this exemplary embodiment, since the halogen heaters 23*a* and 23*b* are used as a heater to heat the fixing belt 21, the inboard edge h2in and the outboard edge h2out of the heat generator h2 of the halogen heater 23*b* in the longitudinal direction thereof define an inboard edge and an outboard edge of a dense coil portion of the filament 51 in the longitudinal direction of the halogen heaters 23*a* and 23*b*.

As described above, the length of the thermal conductor 242 in the longitudinal direction thereof is adjusted such that each outboard edge 242out of the thermal conductor 242 is not disposed outboard from the outboard edge h2out of each of the heat generators h2 of the halogen heater 23*b* in the longitudinal direction thereof, thus preventing the thermal conductor 242 from being elongated excessively in the longitudinal direction thereof. Accordingly, the thermal conductor 242 prevents heat applied to the fixing belt 21 from diffusing to a span being outboard from a maximum conveyance span of the fixing belt 21 in the axial direction thereof. Consequently, the thermal conductor 242 suppresses temperature decrease of the fixing belt 21 in a fixing job to fix the toner image T on the maximum size sheet (e.g., the A3 extension size sheet conveyed in the conveyance span D depicted in FIG. 8).

Additionally, as described above, the length of the thermal conductor 242 in the longitudinal direction thereof is adjusted such that each outboard edge 242out of the thermal conductor 242 is not disposed inboard from each lateral edge of the conveyance span D in the axial direction of the fixing belt 21, thus preventing the thermal conductor 242 from being excessively short in the longitudinal direction thereof. Accordingly, the thermal conductor 242 suppresses overheating of the fixing belt 21 effectively and sufficiently. For example, when a small sheet P such as a postcard spanning the conveyance span A is conveyed over the fixing belt 21, the thermal conductor 242 effectively suppresses overheating of the non-conveyance span of the fixing belt 21 where the small sheet P is not conveyed.

As illustrated in FIGS. 8 and 9, the outboard edge 242out of the thermal conductor 242 is disposed outboard from the maximum conveyance span, that is, the conveyance span D, where the maximum size sheet is conveyed and disposed inboard from the outboard edge h2out of the heat generator h2 of the halogen heater 23*b* in the longitudinal direction thereof. The length of the thermal conductor 242 in the longitudinal direction thereof is suppressed within a range that suppresses temperature decrease of the fixing belt 21 when the maximum size sheet is conveyed over the fixing belt 21 while the thermal conductor 242 is elongated to correspond to various widths of sheets P conveyed through the fixing device 20. Thus, the thermal conductor 242 effectively suppresses overheating of the fixing belt 21 in the non-conveyance span of the fixing belt 21 where the sheets P are not conveyed.

A description is provided of a first variation of the thermal conductor 242.

Figure 11:
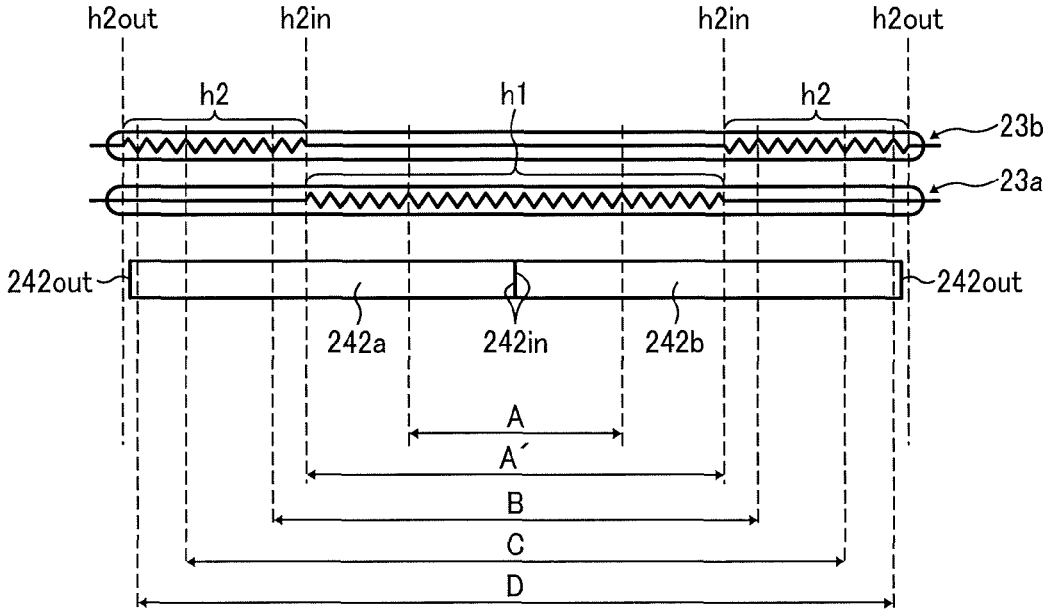
FIG. 11 is a diagram of the halogen heaters and two thermal conductors as a first variation of the thermal conductor depicted in FIG. 9.

FIG. 11 is a diagram of the halogen heaters 23*a* and 23*b* and two thermal conductors 242*a* and 242*b* as the first variation of the thermal conductor 242. As illustrated in FIG. 8, the single thermal conductor 242 extends continuously in the longitudinal direction thereof. Alternatively, as illustrated in FIG. 11, the two thermal conductors 242*a* and 242*b* may be aligned and abutted on each other in a longitudinal direction thereof.

A description is provided of a second variation of the thermal conductor 242.

Figure 12:
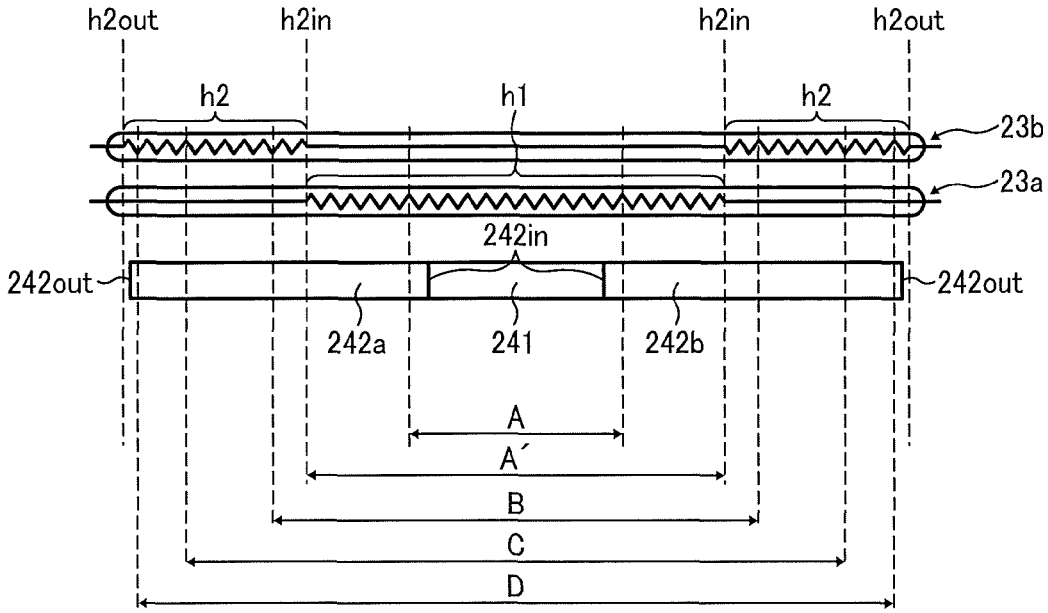
FIG. 12 is a diagram of the halogen heaters and two thermal conductors as a second variation of the thermal conductor depicted in FIG. 9.

FIG. 12 is a diagram of the halogen heaters 23*a* and 23*b* and the two thermal conductors 242*a* and 242*b* as the second variation of the thermal conductor 242. As illustrated in FIG. 12, the two thermal conductors 242*a* and 242*b* are spaced apart from each other in the longitudinal direction thereof. In order to prevent the two thermal conductors 242*a* and 242*b* from producing a step at the fixing nip N, the base 241 or the like is interposed between the thermal conductors 242*a* and 242*b* in the longitudinal direction thereof. As illustrated in FIGS. 11 and 12, like the thermal conductor 242 depicted in FIGS. 8 and 9, the outboard edge 242out of each of the thermal conductors 242*a* and 242*b* is disposed in a span defined from the inboard edge h2in to the outboard edge h2out of the heat generator h2 of the halogen heater 23*b* and disposed outboard from the maximum conveyance span, that is, the conveyance span D, where the maximum size sheet is conveyed, in the longitudinal direction of the halogen heater 23*b*. Accordingly, the thermal conductors 242*a* and 242*b* effectively suppress overheating of the non-conveyance span of the fixing belt 21 where the small sheet P is not conveyed while the thermal conductors 242*a* and 242*b* suppress temperature decrease of each lateral end of the fixing belt 21 that is disposed opposite the maximum size sheet.

As illustrated in FIG. 12, an inboard edge 242in of each of the thermal conductors 242*a* and 242*b* in the axial direction of the fixing belt 21 is disposed opposite or disposed inboard from each lateral edge of the conveyance span A of the postcard in the axial direction of the fixing belt 21. In other words, each of the thermal conductors 242*a* and 242*b* is continuous outward in the axial direction of the fixing belt 21 from each lateral edge of a minimum conveyance span (e.g., the conveyance span A) where a minimum size sheet is conveyed over the fixing belt 21 or a position disposed inboard from each lateral edge of the minimum conveyance span in the axial direction of the fixing belt 21. Accordingly, the thermal conductors 242*a* and 242*b* suppress overheating of the non-conveyance span of the fixing belt 21 where the minimum size sheet is not conveyed.

As described above, the thermal conductors 242, 242*a*, and 242*b* are elongated long enough to diffuse heat stored in the non-conveyance span of the fixing belt 21, which is disposed outboard from the conveyance span A where the small sheet P is conveyed, in the axial direction of the fixing belt 21, thus suppressing overheating of the non-conveyance span of the fixing belt 21 effectively. On the other hand, the thermal conductors 242, 242*a*, and 242*b* are elongated slightly beyond the conveyance span D where the maximum size sheet is conveyed. However, since the outboard edge h2out of the heat generator h2 of the halogen heater 23*b* is disposed opposite substantially each lateral edge of the conveyance span D where the maximum size sheet is conveyed, heat is barely stored in the non-conveyance span of the fixing belt 21 where the maximum size sheet is not conveyed and therefore overheating of the fixing belt 21 barely occurs.

The fixing device 20 according to the exemplary embodiments described above is installed in the image forming apparatus 1 having a print speed (e.g., an image forming speed) defined by the number of prints per minute, that is smaller than 45 copies per minute. If the image forming apparatus 1 has a print speed that is smaller than 45 copies per minute, overheating of the non-conveyance span disposed at each lateral end of the fixing belt 21 in the axial direction thereof is limited. Therefore, the thermal conductors 242, 242*a*, and 242*b* equalize heat stored in the fixing belt 21 in the axial direction thereof sufficiently.

In order to shield the non-conveyance span of the fixing belt 21 from the halogen heater 23*b*, a movable shield may be interposed between the halogen heater 23*b* and the fixing belt 21. As the movable shield moves, the movable shield changes a heating span of the fixing belt 21 that is heated by the halogen heater 23*b* according to the width of the sheet P conveyed over the fixing belt 21. The fixing device 20 depicted in FIG. 2 does not incorporate the movable shield.

Figure 13:
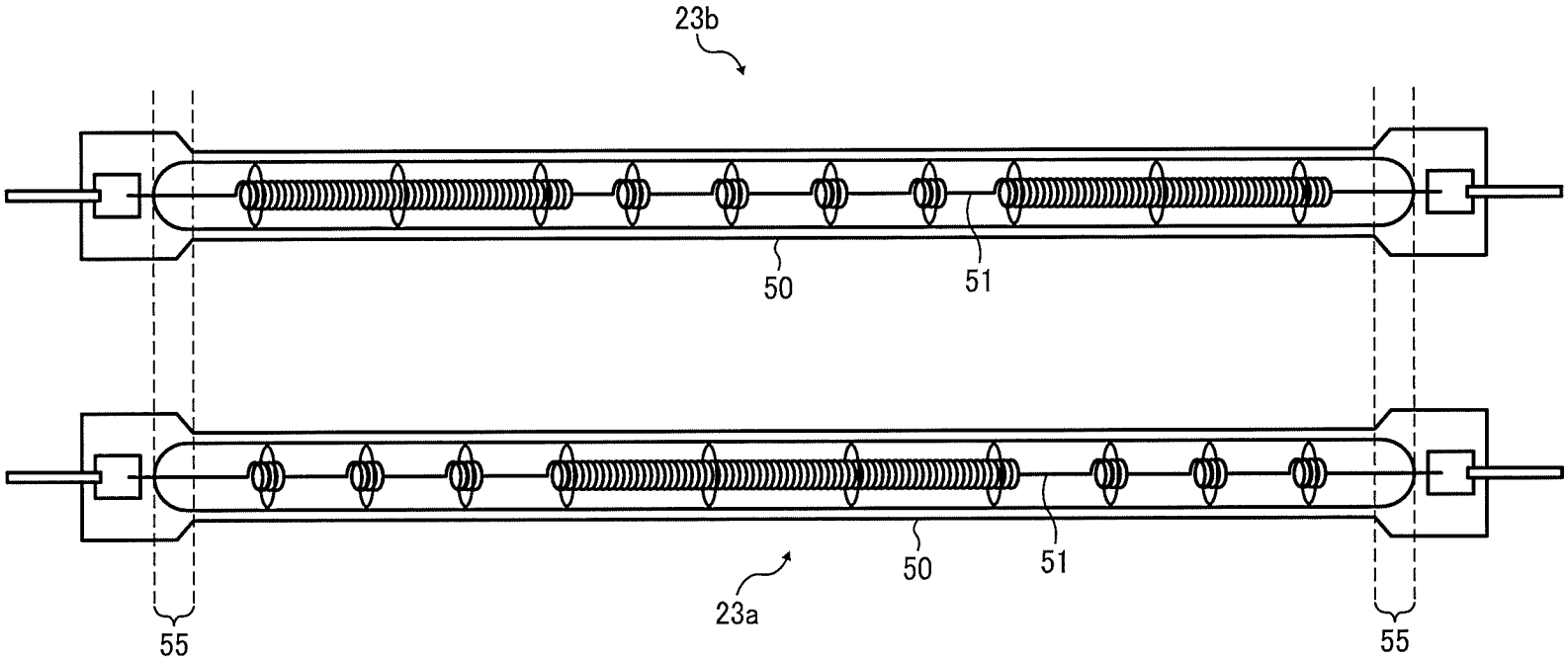
FIG. 13 is a perspective view of the halogen heaters depicted in FIG. 10, illustrating a sealing portion incorporated therein.

Referring to FIG. 13, a description is provided of a configuration of a sealing portion disposed at each lateral end of the glass tube 50 in the longitudinal direction of the halogen heaters 23*a* and 23*b*.

FIG. 13 is a perspective view of the halogen heaters 23*a* and 23*b*. As illustrated in FIG. 13, each of the halogen heaters 23*a* and 23*b* includes a sealing portion 55 disposed at each lateral end of the glass tube 50 in the longitudinal direction of the halogen heaters 23*a* and 23*b*. A loop diameter of the glass tube 50 decreases at each lateral end of the glass tube 50 in a longitudinal direction thereof. Thus, the glass tube 50 narrows at the sealing portion 55, disposed at each lateral end of the glass tube 50 in the longitudinal direction thereof, to seal an interior of the glass tube 50. Alternatively, the sealing portion 55 may include an outermost end of the glass tube 50 that is coupled to a lead wire. Since a loop diameter of the sealing portion 55 is small, a mechanical strength of the sealing portion 55 is smaller than a mechanical strength of other portion of the glass tube 50. Accordingly, the sealing portion 55 is susceptible to thermal degradation and resultant breakage.

Figure 14:
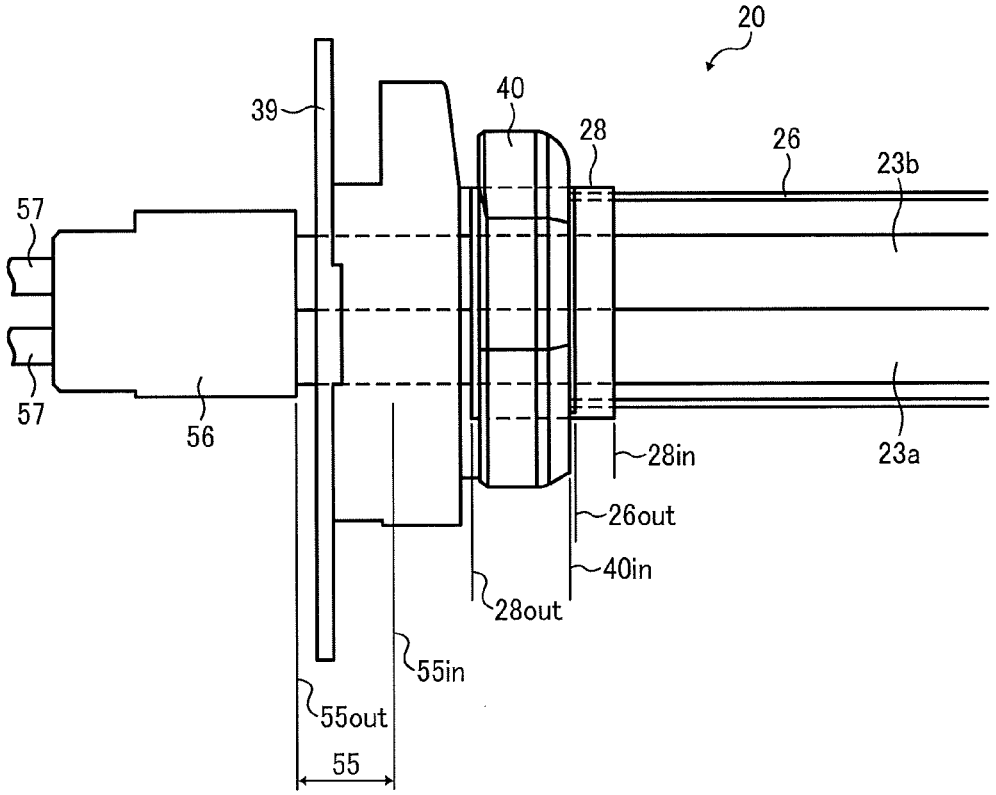
FIG. 14 is a partial side view of the fixing device depicted in FIG. 2, illustrating one lateral end of the fixing device in the longitudinal direction thereof.

Referring to FIG. 14, a description is provided of a positional relation among the reflector 26, the sealing portion 55, and the belt holder 40 in the longitudinal direction of the halogen heaters 23*a* and 23*b*.

FIG. 14 is a partial side view of the fixing device 20, illustrating one lateral end of the fixing device 20 in a longitudinal direction thereof. As illustrated in FIG. 14, the belt holder 40, the stationary shield 28, and other components of the fixing device 20 are disposed at one lateral end of the fixing belt 21 in the axial direction thereof. In order to reflect radiant heat radiated from the halogen heaters 23*a* and 23*b* toward the fixing belt 21 to heat the fixing belt 21 effectively, the reflector 26 is disposed opposite the halogen heaters 23*a* and 23*b* and spans from each lateral end to the center of the fixing belt 21 in the axial direction thereof.

A connector 56 is disposed outboard from the sealing portion 55 of each of the two halogen heaters 23*a* and 23*b* in the longitudinal direction thereof. The connector 56 supports each lateral end of each of the halogen heaters 23*a* and 23*b* in the longitudinal direction thereof. A lead wire 57 is coupled to the connector 56 and extended outward from the connector 56 in the longitudinal direction of the halogen heaters 23*a* and 23*b*. A diameter of the connector 56 is greater than a diameter of the halogen heaters 23*a* and 23*b*. The two halogen heaters 23*a* and 23*b* are supported at an interior of the connector 56.

The sealing portion 55 has an inboard edge 55in and an outboard edge 55out in the longitudinal direction of the halogen heaters 23*a* and 23*b*. According to this exemplary embodiment, the inboard edge 55in of the sealing portion 55 of each of the halogen heaters 23*a* and 23*b* is disposed outboard from an outboard edge 26out of the reflector 26 in the longitudinal direction of the halogen heaters 23*a* and 23*b*. Accordingly, heat or light reflected by the reflector 26 does not reach or barely reaches the sealing portion 55. As described above, the mechanical strength of the sealing portion 55 is smaller than the mechanical strength of other portion of the glass tube 50. As the sealing portion 55 is heated to a high temperature repeatedly by heat reflected by the reflector 26, the sealing portion 55 may be broken over time. To address this circumstance, the sealing portion 55 is disposed outboard from the reflector 26 in the longitudinal direction of the halogen heaters 23*a* and 23*b* so that the sealing portion 55 does not overheat. Accordingly, the sealing portion 55 is protected against thermal degradation and the glass tube 50 defining the sealing portion 55 is immune from breakage such as crack.

An inboard edge 40in of the belt holder 40 is disposed outboard from the outboard edge 26out of the reflector 26 in the longitudinal direction of the halogen heaters 23*a* and 23*b*. Accordingly, heat or light reflected by the reflector 26 does not reach or barely reaches the belt holder 40 or the stationary shield 28 disposed opposite the belt holder 40.

Conversely, if the inboard edge 40in of the belt holder 40 is disposed inboard from the outboard edge 26out of the reflector 26 in the longitudinal direction of the halogen heaters 23*a* and 23*b*, the belt holder 40 is requested to be made of a heat resistant material (e.g., metal) to prevent the belt holder 40 from being adversely affected by heat or light reflected by the reflector 26. To address this circumstance, according to this exemplary embodiment, the belt holder 40 or the stationary shield 28 that protects the belt holder 40 is not susceptible to heat or light reflected by the reflector 26. Hence, the belt holder 40 may be made of resin (e.g., resin having a reduced heat resistance). Thus, the belt holder 40 is made of a material selected from a wide variety of materials, reducing manufacturing costs. If the belt holder 40 is made of a rigid material such as metal, the belt holder 40 may cause abrasion or the like of the fixing belt 21. To address this circumstance, the belt holder 40 is made of resin, preventing abrasion of the fixing belt 21.

A description is provided of a construction of a restraint 58 incorporated in the fixing device 20.

Figure 15:
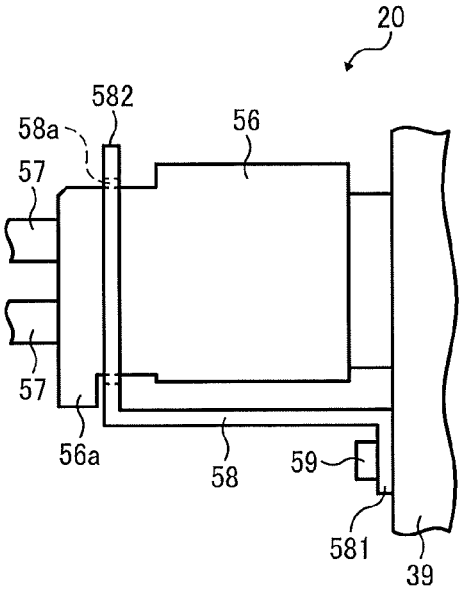
FIG. 15 is a partial side view of the fixing device depicted in FIG. 14, illustrating a restraint incorporated therein.

FIG. 15 is a partial side view of the fixing device 20, illustrating the restraint 58 disposed at one lateral end of the fixing device 20 in the longitudinal direction thereof. The restraint 58 restricts motion of the halogen heaters 23*a* and 23*b* in the longitudinal direction thereof.

As illustrated in FIG. 15, the restraint 58 includes a mounted portion 581 mounted on an outer face of the side plate 39 that is opposite an inner face of the side plate 39 that mounts the mounted portion 403 of the belt holder 40 depicted in FIG. 4. The mounted portion 581 is secured to the side plate 39 with a fastener 59 such as a screw. The restraint 58 further includes a restricting portion 582 disposed outboard from the mounted portion 581 in the longitudinal direction of the halogen heaters 23*a* and 23*b*. The restricting portion 582 includes a through hole 58*a*.

The connector 56 is inserted into the through hole 58*a* of the restraint 58. The connector 56 includes a rib 56*a* disposed outboard from the restricting portion 582 in the longitudinal direction of the halogen heaters 23*a* and 23*b*. The rib 56*a* projects in a radial direction of the halogen heaters 23*a* and 23*b*. The rib 56*a* projects beyond the through hole 58*a* in the radial direction of the halogen heaters 23*a* and 23*b*. As the connector 56 moves rightward in FIG. 15 in the axial direction of the fixing belt 21 relative to the restraint 58, the rib 56*a* comes into contact with the restricting portion 582 of the restraint 58. As the rib 56*a* contacts the restraint 58, the restraint 58 restricts motion of the connector 56 rightward in FIG. 15, that is, inward in the longitudinal direction of the halogen heaters 23*a* and 23*b* or the axial direction of the fixing belt 21. Thus, the restraint 58 restricts a position of the halogen heaters 23*a* and 23*b* relative to the restraint 58 and the side plate 39 in the longitudinal direction of the halogen heaters 23*a* and 23*b*.

The restraint 58 supports the connector 56 also at another lateral end of the fixing device 20 in the longitudinal direction thereof. However, the connector 56 disposed at another lateral end of the fixing device 20 in the longitudinal direction thereof does not incorporate the rib 56*a*. Hence, the restraint 58 does not restrict the position of the connector 56 disposed at another lateral end of the fixing device 20 in the longitudinal direction thereof. If the restraint 58 restricts the position of the halogen heaters 23*a* and 23*b* at each lateral end of the halogen heaters 23*a* and 23*b* in the longitudinal direction thereof, when the connector 56 and the halogen heaters 23*a* and 23*b* expand thermally due to heat generation or the like of the halogen heaters 23*a* and 23*b*, thermal expansion of the connector 56 and the halogen heaters 23*a* and 23*b* is not absorbed, resulting in breakage of parts of the fixing device 20.

To address this circumstance, according to this exemplary embodiment, the rib 56*a* is disposed at one of the connectors 56 that is disposed at one lateral end of the halogen heaters 23*a* and 23*b* in the longitudinal direction thereof to restrict the position of the halogen heaters 23*a* and 23*b* in the longitudinal direction thereof. Accordingly, even if the connector 56 and the halogen heaters 23*a* and 23*b* expand thermally, thermal expansion of the connector 56 and the halogen heaters 23*a* and 23*b* is absorbed at another lateral end of the halogen heaters 23*a* and 23*b* in the longitudinal direction thereof, preventing breakage of parts of the fixing device 20.

The restraint 58 restricts the position of the halogen heaters 23*a* and 23*b* at one lateral end of the halogen heaters 23*a* and 23*b* in the longitudinal direction thereof and allows the halogen heaters 23*a* and 23*b* that thermally expand to elongate at another lateral end of the halogen heaters 23*a* and 23*b* in the longitudinal direction thereof. A positional relation between the halogen heaters 23*a* and 23*b* and peripheral components, that is seen from one lateral end of the halogen heaters 23*a* and 23*b* in the longitudinal direction thereof does not deviate or barely deviates due to thermal expansion of the connector 56 and the halogen heaters 23*a* and 23*b*. Thus, the positional relation among the sealing portion 55, the belt holder 40, and the reflector 26 depicted in FIG. 14 is retained.

The present disclosure is not limited to the details of the exemplary embodiments described above and various modifications and improvements are possible. For example, the exemplary embodiments of the fixing device 20 are explained with the postcard, the A4 size sheet in portrait orientation, the B4 size sheet in portrait orientation, the A3 size sheet in portrait orientation, and the A3 extension size sheet that are used as the sheets P. Alternatively, the exemplary embodiments described above are applicable to fixing devices that use a letter size sheet in portrait orientation, a double letter size sheet in portrait orientation, and the like as the sheets P.

A description is provided of advantages of the fixing device 20.

As illustrated in FIG. 2, a fixing device (e.g., the fixing device 20) includes an endless fixing belt (e.g., the fixing belt 21), a primary heater (e.g., the halogen heater 23*a*), a secondary heater (e.g., the halogen heater 23*b*), a nip formation pad (e.g., the nip formation pad 24), and an opposed rotator (e.g., the pressure roller 22). The fixing belt is rotatable in a rotation direction (e.g., the rotation direction D21). The primary heater and the secondary heater are disposed opposite an inner circumferential surface of the fixing belt to heat the fixing belt.

As illustrated in FIG. 8, the primary heater includes a center heat generator (e.g., the heat generator h1) disposed opposite a center span of the fixing belt in an axial direction thereof. The secondary heater includes a lateral end heat generator (e.g., the heat generator h2) disposed opposite a lateral end span of the fixing belt in the axial direction thereof.

As illustrated in FIG. 2, the nip formation pad is disposed opposite the inner circumferential surface of the fixing belt. The opposed rotator is disposed opposite an outer circumferential surface of the fixing belt and pressed against the nip formation pad via the fixing belt to form a fixing nip (e.g., the fixing nip N) between the fixing belt and the opposed rotator, through which a recording medium (e.g., a sheet P) bearing a toner image (e.g., a toner image T) is conveyed. The nip formation pad includes a base (e.g., the base 241) and a thermal conductor (e.g., the thermal conductors 242, 242*a*, and 242*b*) being interposed between the base and the fixing nip and having a thermal conductivity greater than a thermal conductivity of the base.

As illustrated in FIG. 8, the lateral end heat generator includes an inboard edge (e.g., the inboard edge h2in) and an outboard edge (e.g., the outboard edge h2out) disposed outboard from the inboard edge in the axial direction of the fixing belt. The inboard edge of the lateral end heat generator is closer to a center of the fixing belt in the axial direction thereof than the outboard edge is. The outboard edge of the lateral end heat generator is disposed opposite a lateral end of the fixing belt in the axial direction thereof.

As illustrated in FIG. 8, the thermal conductor includes an outboard edge (e.g., the outboard edge 242out) disposed in a span defined between the inboard edge and the outboard edge of the lateral end heat generator in a longitudinal direction of the secondary heater parallel to the axial direction of the fixing belt. The outboard edge of the thermal conductor is disposed outboard from a conveyance span (e.g., the conveyance span D) of the fixing belt in the axial direction thereof where the recording medium is conveyed over the fixing belt. The recording medium of a maximum size available in the fixing device is conveyed over the conveyance span of the fixing belt.

The outboard edge of the thermal conductor in the axial direction of the fixing belt is defined relative to the secondary heater and the conveyance span of the fixing belt where the recording medium is conveyed. Accordingly, the thermal conductor effectively suppresses overheating or temperature increase of a non-conveyance span of the fixing belt where the recording media of various sizes are not conveyed while the thermal conductor retains productivity defined by a fixing speed at which the fixing device performs a fixing job to fix the toner image on the recording medium.

According to the exemplary embodiments described above, the fixing belt 21 serves as a fixing belt. Alternatively, a fixing film, a fixing sleeve, or the like may be used as a fixing belt. Further, the pressure roller 22 serves as an opposed rotator. Alternatively, a pressure belt or the like may be used as an opposed rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing belt being endless and rotatable in a rotation direction;

a primary heater, disposed opposite an inner circumferential surface of the fixing belt, to heat the fixing belt, the primary heater including a center heat generator disposed opposite a center span of the fixing belt in an axial direction of the fixing belt;

a secondary heater, disposed opposite the inner circumferential surface of the fixing belt, to heat the fixing belt, the secondary heater including a lateral end heat generator disposed opposite a lateral end span of the fixing belt in the axial direction of the fixing belt;

a nip formation pad disposed opposite the inner circumferential surface of the fixing belt; and an opposed rotator to press against the nip formation pad via the fixing belt to form a fixing nip between the fixing belt and the opposed rotator, the fixing nip through which a recording medium bearing a toner image is conveyed, the nip formation pad including:

a base; and at least one thermal conductor being interposed between the base and the fixing nip and having a thermal conductivity greater than a thermal conductivity of the base, the at least one thermal conductor including an outboard edge disposed between an inboard edge and an outboard edge of the lateral end heat generator in the axial direction of the fixing belt and disposed outboard from a conveyance span of the fixing belt in the axial direction of the fixing belt, the conveyance span where the recording medium is conveyed over the fixing belt.

2. The fixing device according to claim 1, wherein the conveyance span of the fixing belt includes a maximum conveyance span where the recording medium of a maximum size available in the fixing device is conveyed over the fixing belt.

3. The fixing device according to claim 1, further comprising a stationary shield to shield the fixing belt from the secondary heater, the stationary shield including an outboard edge disposed outboard from the outboard edge of the lateral end heat generator in the axial direction of the fixing belt.

4. The fixing device according to claim 3, wherein the stationary shield further includes an inboard edge disposed outboard from the outboard edge of the lateral end heat generator in the axial direction of the fixing belt.

5. The fixing device according to claim 1, further comprising a slot disposed outboard from the at least one thermal conductor in the axial direction of the fixing belt.

6. The fixing device according to claim 5, wherein a length of the slot is not smaller than a half of a length of the at least one thermal conductor in a recording medium conveyance direction.

7. The fixing device according to claim 6, wherein the slot includes an inboard edge corresponding to the outboard edge of the at least one thermal conductor in the axial direction of the fixing belt.

8. The fixing device according to claim 1, wherein the at least one thermal conductor further includes:

a first thermal conductor; and a second thermal conductor aligned with the first thermal conductor in the axial direction of the fixing belt.

9. The fixing device according to claim 8, wherein the conveyance span of the fixing belt includes a minimum conveyance span where the recording medium of a minimum size available in the fixing device is conveyed over the fixing belt.

10. The fixing device according to claim 9, wherein each of the first thermal conductor and the second thermal conductor is continuous outward in the axial direction of the fixing belt from each lateral edge of the minimum conveyance span in the axial direction of the fixing belt.

11. The fixing device according to claim 9, wherein each of the first thermal conductor and the second thermal conductor is continuous outward in the axial direction of the fixing belt from a position disposed inboard from each lateral edge of the minimum conveyance span in the axial direction of the fixing belt.

12. The fixing device according to claim 11, wherein the base is interposed between the first thermal conductor and the second thermal conductor in the axial direction of the fixing belt.

13. The fixing device according to claim 1, wherein the secondary heater includes a halogen heater including a filament, wherein the lateral end heat generator defines a dense coil portion of the filament, and wherein the inboard edge and the outboard edge of the lateral end heat generator define an inboard edge and an outboard edge of the dense coil portion of the filament in the axial direction of the fixing belt, respectively.

14. The fixing device according to claim 13, further comprising a reflector to reflect heat radiated from the primary heater and the secondary heater to the fixing belt.

15. The fixing device according to claim 14, wherein the secondary heater further includes:

a glass tube; and a sealing portion sealing the glass tube, and wherein an inboard edge of the sealing portion is disposed outboard from an outboard edge of the reflector in the axial direction of the fixing belt.

16. The fixing device according to claim 15, further comprising a belt holder supporting the fixing belt, wherein an inboard edge of the belt holder is disposed outboard from the outboard edge of the reflector in the axial direction of the fixing belt.

17. The fixing device according to claim 1, further comprising:

a side plate supporting the primary heater and the secondary heater;

a restraint being mounted on the side plate and including a through hole; and a connector supporting the primary heater and the secondary heater and being inserted into the through hole of the restraint, the connector including a rib to come into contact with the restraint to restrict motion of the primary heater and the secondary heater in the axial direction of the fixing belt.

18. The fixing device according to claim 1, wherein the primary heater and the secondary heater heat a heating span of the fixing belt directly, the heating span being disposed outboard from the fixing nip in the rotation direction of the fixing belt.

19. An image forming apparatus comprising:

an image forming device to form a toner image; and a fixing device disposed downstream from the image forming device in a recording medium conveyance direction to fix the toner image on a recording medium, the fixing device including:

a fixing belt being endless and rotatable in a rotation direction;

a primary heater, disposed opposite an inner circumferential surface of the fixing belt, to heat the fixing belt, the primary heater including a center heat generator disposed opposite a center span of the fixing belt in an axial direction of the fixing belt;

a secondary heater, disposed opposite the inner circumferential surface of the fixing belt, to heat the fixing belt, the secondary heater including a lateral end heat generator disposed opposite a lateral end span of the fixing belt in the axial direction of the fixing belt;

a nip formation pad disposed opposite the inner circumferential surface of the fixing belt; and an opposed rotator to press against the nip formation pad via the fixing belt to form a fixing nip between the fixing belt and the opposed rotator, the fixing nip through which the recording medium bearing the toner image is conveyed, the nip formation pad including:

a base; and at least one thermal conductor being interposed between the base and the fixing nip and having a thermal conductivity greater than a thermal conductivity of the base, the at least one thermal conductor including an outboard edge disposed between an inboard edge and an outboard edge of the lateral end heat generator in the axial direction of the fixing belt and disposed outboard from a conveyance span of the fixing belt in the axial direction of the fixing belt, the conveyance span where the recording medium is conveyed over the fixing belt.

20. The image forming apparatus according to claim 19, wherein the image forming device forms the toner image and the fixing device fixes the toner image on the recording medium at a speed smaller than 45 copies per minute.

* * * * *